US005967046A

United States Patent [19]

Müller

[11] Patent Number: 5,967,046

[45] **Date of Patent: *Oct. 19, 1999**

[54] PRINTING MACHINE CYLINDER WITH AN ANTI-CORROSION PROTECTIVE LAYER, AND METHOD FOR PRODUCING SUCH A CYLINDER

[75] Inventor: Matthias Müller, Wiesloch-Baiertal, Germany

[73] Assignee: Heidelberger Druckmaschinen AG, Heidelberg, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/851,016

[22] Filed: May 5, 1997

[30] Foreign Application Priority Data

May 3, 1996 [DE] Germany ..... 196 17 745

[51] Int. Cl.[6] ..... B41F 13/193

[52] U.S. Cl. ..... 101/375; 492/54

[58] Field of Search ..... 492/54; 101/375

[56] References Cited

U.S. PATENT DOCUMENTS

| | | | |
|---|---|---|---|
| 4,491,082 | 1/1985 | Barch et al. | 101/375 |
| 4,503,769 | 3/1985 | Andersen | 101/153 |
| 5,102,746 | 4/1992 | Shindou et al. | 428/623 |
| 5,304,401 | 4/1994 | Shindou et al. | 427/410 |
| 5,528,987 | 6/1996 | Andersson et al. | 101/219 |
| 5,607,521 | 3/1997 | Bech-Nielsen et al. | 148/261 |

FOREIGN PATENT DOCUMENTS

| | | | |
|---|---|---|---|
| 886.580 | 10/1943 | France . | |
| 886.685 | 10/1943 | France . | |
| 60196208 | 10/1985 | Japan | 492/54 |
| 2031801 | 4/1980 | United Kingdom | 101/375 |

*Primary Examiner*—Edgar Burr
*Assistant Examiner*—Amanda B. Sandusky
*Attorney, Agent, or Firm*—Herbert L. Lerner; Laurence A. Greenberg

[57] ABSTRACT

A method for coating a printing machine cylinder, especially a rubber blanket cylinder of a web- or sheet-fed rotary offset printing machine, includes applying to a cylinder body a first layer containing at least one zinc-bearing substance selected from the group consisting of ZnFe, ZnCo, ZnNi and Zn.

13 Claims, 1 Drawing Sheet

PRINTING MACHINE CYLINDER WITH AN ANTI-CORROSION PROTECTIVE LAYER, AND METHOD FOR PRODUCING SUCH A CYLINDER

BACKGROUND OF THE INVENTION

Field of the Invention

The invention relates to a printing machine cylinder, especially a rubber blanket cylinder, for a web-fed or sheet-fed rotary offset printing machine, having a layer which is protective against corrosion, and to a method for producing such a printing machine cylinder.

Printing machine cylinders installed in modern printing machines, especially rubber blanket cylinders of web-fed or sheet-fed rotary offset printing machines, have been known heretofore to be coated with an anti-corrosion protective layer to prevent corrosion of the cylinder surface. In the case of printing machine cylinders having cylinder bodies which are formed by foliated or globular gray cast iron or steel, for example, anti-corrosion protection is effected after manufacture, by phosphating and oiling the surface of the cylinder jacket. Because the oiling in these cylinders represents the sole protection against corrosion of the cylinder surface, it is often observed that the cylinder surface in the region of damage exhibits marked traces of corrosion, and that the locations where the film of oil was removed, marked corrosion phenomena occur, which no longer permit such a cylinder to be used in a printing machine and persistently impair printing quality, respectively.

It has also become known in the prior art to plate printing machine cylinders with chromium or nickel or to coat them with a sprayed film of fine or high-grade steel.

Besides the comparatively high costs of coating, in these coating methods, as a rule, post-machining of the cylinder-jacket or outer cylindrical surface is necessary, and the aforementioned coatings can, as a rule, be made only whenever the fittings secured to the cylinder bodies, such as bearing rings, flanges, and so forth are removed beforehand.

SUMMARY OF THE INVENTION

It is accordingly an object of the invention to provide a printing machine cylinder which has high resistance to corrosion and can be manufactured economically and with such high precision that, as a rule, post-machining of the cylinder surface can be omitted. It is also an object of the invention to provide a method of economically coating, with high-precision, a printing machine cylinder, especially a rubber blanket cylinder formed of gray cast iron or steel in a web-fed or sheet-fed rotary offset printing machine, with an anti-corrosion protective layer.

With the foregoing and other objects in view, there is provided, in accordance with one aspect of the invention, a method for coating a printing machine cylinder, which comprises applying to a cylinder body a first layer containing at least one zinc-bearing substance selected from the group consisting of ZnFe, ZnCo, ZnNi and Zn.

In accordance with another mode, the method of the invention includes providing the base material of the cylinder body of one of foliated or globular gray cast iron and steel.

In accordance with a further mode, the method of the invention includes applying the first layer by electroplating.

In accordance with an added mode, the method of the invention includes forming the first layer with a thickness in a range between 2 $\mu$m and 30 $\mu$m.

In accordance with a more specific mode, the method of the invention includes forming the first layer with a thickness ranging from 8 to 12 $\mu$m.

In accordance with an additional mode, the method of the invention includes chromating the first layer so as to form a second layer applied over the first layer.

In accordance with yet another mode, the method of the invention calls for the chromating to be applied in the form of at least one chromating selected from the group consisting of a black, yellow and blue chromating.

In accordance with yet a further mode, the method of the invention includes immersing the cylinder in a chromate bath so as to effect the chromating of the first layer.

In accordance with yet an added mode the method of the invention includes providing a third layer formed as an immersion seal over the second layer so as to prevent liberation of chromate(VI) ions from the second layer.

In accordance with another aspect of the invention, there is provided a printing machine cylinder having a cylinder body formed of foliated or globular gray cast iron or steel, comprising a first layer applied to the cylinder body, said first layer containing at least one zinc-bearing substance selected from the group consisting of ZnFe, ZnCo, ZnNi and Zn.

In accordance with another feature of the invention, the first layer is an electroplating from an immersion bath.

In accordance with a further feature of the invention, the first layer has a thickness ranging between 2 $\mu$m and 30 $\mu$m.

In accordance with a more specific feature of the invention, the first layer has a thickness ranging between 8 to 12 $\mu$m.

In accordance with an added feature of the invention, the printing machine cylinder includes a second layer containing a zinc chromate compound disposed on the first layer.

In accordance with an additional feature of the invention, the second layer is formed of at least one of a black, yellow and blue chromating of said first layer.

In accordance with yet another feature of the invention, the second layer is of a type formed by immersion of the cylinder body in a chromate bath.

In accordance with yet a further feature of the invention, a third layer is provided over the second layer, the third layer being formed as an immersion seal for preventing liberation of chromate(VI) ions from the second layer.

In accordance with a concomitant feature of the invention, the printing machine cylinder is a rubber blanket cylinder of one of a web-fed and a sheet-fed rotary offset printing machine.

Other features which are considered as characteristic for the invention are set forth in the appended claims.

Although the invention is illustrated and described herein as embodied in a printing machine cylinder with an anti-corrosion protective layer, and a method for producing such a cylinder, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing, wherein:

DESCRIPTION OF THE PREFERRED EMBODIMENT

Figure 1:
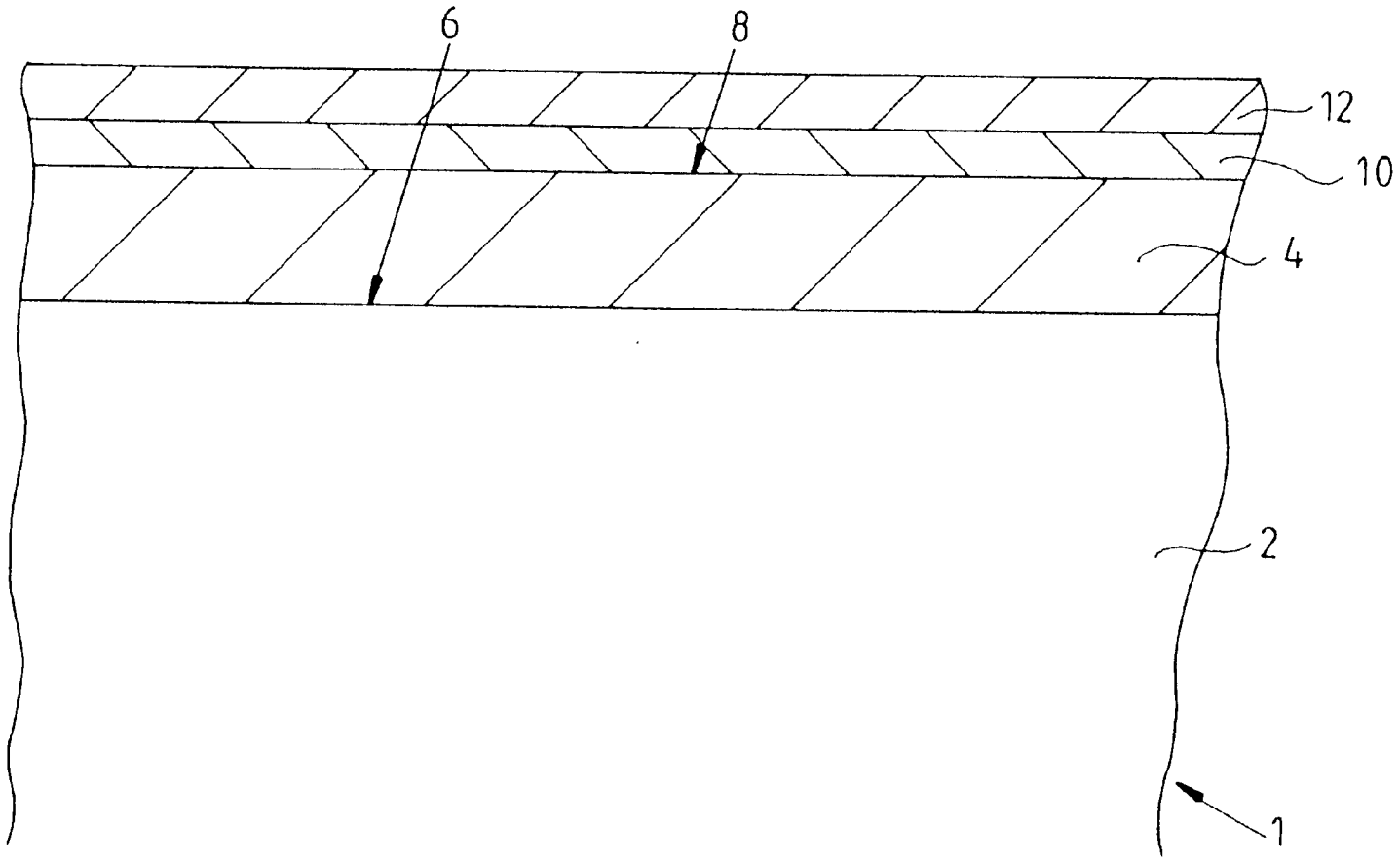
FIG. 1 is a fragmentary cross-sectional view of a printing machine cylinder provided with an anti-corrosion protective layer according to the invention.

Referring now to FIG. 1 of the drawing, there is shown therein a first layer 4, which is formed of zinc or a zinc alloy or contains such an alloy, and is applied to a base body 2 of a printing machine cylinder 1, which may, in particular, be a rubber blanket cylinder of a web-fed or sheet-fed rotary offset printing machine. The base body 2 of the printing machine cylinder 1 may be fabricated in a conventional manner from foliated or globular gray cast iron or from steel; the surface of the base body 2 should be subjected to post-machining if necessary, with a view to the manufacturing dimensions of the cylinder which must be adhered to. The zinc alloy of the first layer 4, in a preferred embodiment of the invention, may be formed of ZnFe but can also be formed in a similar manner of Zn, ZnCo, or ZnNi, or one or more of the zinc compounds mentioned. The method according to the invention and the apparatus according to the invention may, however, be employed in the same way on other components used in the printing machine, in particular rollers, for example, in the inking and dampening unit of the printing machine.

In the preferred embodiment of the invention, the coating of zinc or zinc alloy is preferably applied by electroplating, for example, in an alkaline immersion bath. The coating or layer has a thickness of between 2 $\mu$m and 30 $\mu$m, and preferably from 8 to 12 $\mu$m. The first layer 4, in the case of electroplating, may be applied with such high accuracy that a subsequent post-machining of the surface of the base body 2, as is necessary in order to adhere to the required diameter tolerances in the case of chrome-plating or nickel-plating of the cylinder, may be omitted.

In a preferred embodiment of the invention, the base body 2 coated with the first layer 4 is treated with a chromate compound, which produces passivation of the first layer 4 in the region of the surface 8 thereof. In FIG. 1, a second layer 10 is shown which is created by the passivation of the first layer 4, although strictly speaking it is created by a transformation of the surface of the first layer 4. The second layer 10 is preferably produced by dipping the printing machine cylinder 1, provided with the first layer 4, in a chromate bath, the chromating being performed, for example, in the form of black and/or yellow and/or blue chromating. Because only a very brief immersion of the cylinder body 1 with the first layer 4 disposed thereon in a chromate bath is sufficient to create the second layer 10, the possibility also exists of leaving on the printing machine cylinder any bearer or Schmitz rings and other parts, which are generally mounted on a printing machine cylinder, because they are attacked only slightly due to the brief exposure time. This has an enormous cost advantage, because the printing machine cylinders can be coated in a previously completely assembled state.

In a further embodiment of the invention, a third layer 12 in the form of an immersion seal is applied over the second layer 10, and serves to prevent the liberation of chromate-(VI) ions from the second layer 10. The third layer 12 may be formed, in a conventional manner, of an acrylate compound.

As has been demonstrated in practice, a printing machine cylinder 1 coated with the first layer 4 and with both the first layer 4 and the second layer 10, respectively, exhibits a high corrosion-resistance capability against damage which is caused by the action of hard objects, and so forth on the surfaces produced in the manner described hereinabove. It has been found that, in the case of slight damage to the cylinder surface due to cathodic corrosion protection action of the layer 4, a "healing" of the damage can, in fact, be observed. Consequently, even over the long term, no significant impairment in printing quality need be expected from an accumulation of slight damages.

I claim:

1. A method for coating a printing machine cylinder, which comprises:

providing a rotary printing machine cylinder body formed of gray cast iron or steel;

applying to the cylinder body a first layer with a high accuracy such that a subsequent post-machining is unnecessary, the first layer having a substantially uniform thickness and containing at least one zinc-bearing substance selected from the group consisting of ZnFe, ZnCo, ZnNi and Zn by electroplating in an immersion bath; and chromating the first layer so as to form a second layer applied over the first layer.

2. The method according to claim 1, providing the base material of the cylinder body of one of foliated or globular gray cast iron or steel.

3. The method according to claim 1, which includes forming the first layer with a thickness in a range between 2 $\mu$m and 30 $\mu$m.

4. The method according to claim 1, which includes forming the first layer with a thickness ranging from 8 to 12 $\mu$m.

5. The method according to claim 1, wherein the chromating is applied in the form of at least one chromating selected from the group consisting of a black, yellow and blue chromating.

6. The method according to claim 1, which includes immersing the cylinder in a chromate bath so as to effect the chromating of the first layer.

7. The method according to claim 1, which includes providing a third layer formed as an immersion seal over the second layer so as to prevent liberation of chromate(VI) ions from the second layer.

8. A printing machine cylinder, comprising:

a rotary printing machine cylinder body formed of cast iron or steel;

a first layer applied to said cylinder body by electroplating in an immersion bath, said first layer having a substantially uniform thickness and containing at least one zinc-bearing substance selected from the group consisting of ZnFe, ZnCo, ZnNi and Zn, said first layer applied with a high accuracy such that a subsequent post-machining is unnecessary; and a second layer containing a zinc chromate compound disposed on said first layer.

9. The printing machine cylinder according to claim 8, wherein said first layer has a thickness ranging between 2 $\mu$m and 30 $\mu$m.

10. The printing machine cylinder according to claim 8, wherein said first layer has a thickness ranging between 8 to 12 $\mu$m.

11. The printing machine cylinder according to claim 8, wherein said second layer is formed of at least one of a black, yellow and blue chromating of said first layer.

12. The printing machine cylinder according to claim 8, wherein said second layer is of a type formed by immersion of the cylinder body in a chromate bath.

13. The printing machine cylinder according to claim 8, wherein a third layer is provided over the second layer, said third layer being formed as an immersion seal for preventing liberation of chromate(VI) ions from said second layer.

* * * * *